US005803296A

United States Patent [19]

Olson

[11] Patent Number: 5,803,296

[45] Date of Patent: Sep. 8, 1998

[54] COLLAPSIBLE, STACKABLE, HARD-SIDED CONTAINER

[76] Inventor: David A. Olson, 12 Ridge Rd., St. Peter, Minn. 56082

[21] Appl. No.: 835,736

[22] Filed: Apr. 10, 1997

Related U.S. Application Data

[63] Continuation of Ser. No. 714,580, Sep. 16, 1996.

[51] Int. Cl.[6] ..... B65D 21/00

[52] U.S. Cl. ..... 220/6; 220/1.5

[58] Field of Search ..... 220/1.5, 6, 7

[56] References Cited

U.S. PATENT DOCUMENTS

| | | | |
|---|---|---|---|
| 4,186,841 | 2/1980 | Buckley et al. | 220/6 |
| 4,280,640 | 7/1981 | Daloisio | 220/1.5 X |
| 4,662,532 | 5/1987 | Anderson et al. | 220/6 X |
| 4,735,330 | 4/1988 | Hoss | 220/6 |
| 4,785,966 | 11/1988 | Waltke | 220/1.5 X |
| 5,564,599 | 10/1996 | Barber et al. | 220/6 X |

*Primary Examiner*—Steven M. Pollard
*Attorney, Agent, or Firm*—Oliff & Berridge, PLC

[57] ABSTRACT

A container having a base portion including four vertical square tube members of equal length with one tube member at each corner of the base portion, and bottom surfaces of the base portion sloping inwardly to an opening assembly at the bottom of the base portion that consists of a series of uniformly spaced openings closed by a spring loaded horizontally sliding door. The upper portion of the container is formed with four additional vertical square tube members of equal length that provide support for the upper sides of the container, with the upper side walls being pinned to the lower vertical tube members such that the four sides of the container can be rotated downwardly onto the base portion when the container is empty. When the side walls are rotated to an upright position the four upper sides interlock and are held in position by pressure within the container. The structure of the base portion allows lifting and transport by forklift, pallet jacks or similar devices. The spring loaded slide door assembly may be opened remotely with a line connected to a lever mechanism attached either to the container base or to the forklift to permit unloading of the container contents by the lift operator from the seat of the lift vehicle.

13 Claims, 13 Drawing Sheets

COLLAPSIBLE, STACKABLE, HARD-SIDED CONTAINER

This application is a continuation of U.S. Pat. application Ser. No. 08/714,580, filed Sep. 16, 1996, which is herein incorporated by reference.

BACKGROUND OF THE INVENTION

1. Field of Invention

This invention pertains to a collapsible, stackable container for holding and distributing bulk quantities of loose materials. More specifically, the invention is directed to a collapsible, stackable container for holding and distributing bulk quantities of seed used in the agricultural industry.

2. Related Art

In the agricultural industry, amongst other industries, there is often the need for a stackable container which can carry bulk quantities of loose materials, and which can be emptied safely and efficiently and subsequently collapsed to smaller size for compact storage when not in use. In the seed processing industry an existing method for bulk seed distribution is a large bag with a drawstring closure at the bottom. Such a bag is plagued with several problems. The bag is not stable and cannot be stacked. This results in a significant reduction of warehouse capacity. Prior to the adoption of the bulk bags, seed companies had stacked pallets of fifty bags four high. The inability to stack bulk bags reduces warehouse capacity to one quarter of its previous use. Even stacking the bulk bags two high still cuts warehouse capacity in half. When such a bag is filled with seed it can weigh up to 2,500 pounds, thus it is very difficult to move or handle efficiently. Existing bulk seed bags are equipped with loops at the top of the bag to receive forklift tines. Unfortunately, during shipment the bags full of seed often shift, making it difficult to align the loops with the tines of the forklift.

The process of emptying the bag of seed into a customer's truck or wagon involves the dangerous procedure of raising the bag hanging from fork lift tines over the side of the truck or wagon and then reaching underneath the bag filled with over a ton of seed to untie the drawstring closure. To get the bottom of the bag over the side of a truck or wagon requires raising the lift tines six feet seven inches or more above the top of the truck side wall which may be ten or twelve feet high. This high lift requires either unusual equipment or the extension of typical forklifts to their limit of stability and safety. Various frames or cradles have been designed to help lift the bags, but these do not eliminate the need to climb up the side of the truck or wagon and reach under the bag to untie the drawstring closure.

A further disadvantage of the existing bag containers for bulk seed is the time that it takes to empty the bag and the inability to stop the flow of contents out of the bag once started until the bag is nearly empty. A bag filled with 2,500 pounds of seed can take 45 seconds or more to empty and usually the bag must be shaken to completely empty. Shaking out the last bushel or two requires an additional climb up the side of the truck or wagon to reach the bag. When empty, the bags must be pulled off the fork tines, requiring the driver to get down from the seat of the forklift. A final disadvantage of the bag, if it is to be reused, is that it must be hand washed to remove residue that sticks to the bag material.

Additional existing containers for transporting bulk quantities of loose materials include some hard sided containers constructed of plastic or steel. Existing plastic containers lack the capacity to hold the equivalent of fifty bags of seed and the strength or stability to be stacked four high. Furthermore, existing hard sided containers lack any features that allow the containers to be opened for emptying by the forklift driver without having to get down from the driver's seat, and furthermore, cannot be emptied appreciably faster than existing bag containers.

SUMMARY OF THE INVENTION

An object of the present invention is to provide a stable container that can be stacked four high when filled and that can be collapsed when empty to less than half of its uncollapsed height without the use of tools or fasteners. A further object of the present invention is to provide a container which can be easily lifted by a lift truck and then emptied by the lift truck driver without having to step down from the driver's seat of the lift truck. Another object of the present invention is to provide a container that can hold the equivalent of 50 bags of seed, which is the existing industry standard shipped on one pallet, and which can be emptied completely of the seed in thirty to thirty-five seconds. To do this the container must have an interior volume of at least 56 cubic feet and be able to hold up to 2,500 pounds of seed and have no surface with less than a thirty degree slope. Yet another object is to provide containers having a width that allows two containers to be fitted side by side in a standard truck trailer. A further object of this invention is to make it possible to stop the flow of contents from the container once begun and to be able to start or stop the flow of contents at any point by the forklift driver without having to leave the driver's seat.

According to the present invention, the foregoing and other objectives and advantages are obtained by a container having a base portion including four vertical square tube members with one tube member of equal length at each corner of the base portion, and the bottom surfaces of the base portion sloping inward to a series of openings at the bottom of the base. The series of openings at the bottom of the base are closed off by a series of interconnected panels which move horizontally to open or close. The upper portion of the container is formed with four additional vertical square tube members of equal length that provide support for the upper sides of the container, with the upper square tube members and sides of the container being pinned to the lower vertical square tube members such that the four sides of the container can be folded downwardly onto the base portion when the container is emptied.

The slide door of the container is a series of interconnected panels attached between two members which are slidably supported across three pipes or tube members running perpendicular to the direction of door movement. These round pipes or tubes are connected to two flat bars which run parallel across the bottom of the container. The opening at the bottom of the sloped sides is divided into a series of rectangular holes by angles connected to plates extending from the bottom of the sloped sides.

A separate mechanism attached to the base of the container or attached to the forklift tines opens the door at the bottom of the container. If attached to the forklift tines, the mechanism is mounted on the tines before the tines are inserted into the openings along the base of the container and remains attached to the forklift for emptying as many filled containers as necessary. The front plate of the mechanism is positioned adjacent a spring-loaded end plate of the slide door at the base of the container. A lever extending from a pipe or tube across the top of the opening mechanism is connected by a flexible line to a point within reach of the driver of the lift truck when the driver is operating the lift truck. Pulling on the flexible line by the lift truck driver results in the rotation of the round pipe or tube across the top of the mechanism. The round tube or pipe is connected to a smaller lever which, when the pipe is rotated, extends a flat bar assembly which presses against the spring loaded plate at the end of the door causing the spring to compress and the door to move.

When the four collapsible sides of the container are positioned in the upright position for receipt of the material to be carried by the container, the sides are retained in position by four vertical angle keepers that are each attached to one of the four upper square tube members. The four upper side members are collapsed from a vertical position to a horizontal position on top of the base portion by pushing in at the top of the two longest sides which pivot at the base and then first lifting each of the remaining two shorter sides a small distance vertically and then rotating the side from its vertical position to a horizontal position on top of the base portion.

Each of the sides is attached to a flat bar member that extends along the entire height of each of the vertical edges of the sides. The flat bar members along the edges of the sides are each provided with an elongated hole at the lower end of each of the sides. Each of the elongated holes at the lower ends of the sides accepts a horizontal pin extending from each of the lower square tube members at the four corners of the base portion of the container.

The open tops of each of the square tube members at the four corners of the base portion accept an alignment tab extending downwardly a short distance from the bottom of each of the upper square tube members. The alignment tabs provide alignment between the square tube members on the base portion of the container and the square tube members along the edges of the upper sides of the container and hold the two longest side walls in place while the two shortest side walls are pivoted to the vertical position. The longest side walls are rotated to the vertical position first followed by the shortest two side walls, and the shortest side walls are folded first followed by the longer side walls.

The slots through the bottom of the flat bars attached to the edges of the side walls allow the sides to be lifted vertically relative to the horizontal pins extending from the lower square tube members. This vertical movement of the side disengages the alignment tabs extending from the upper square tube members into the lower square tube members such that the sides can be pivoted about the horizontal pins to a horizontal position and back to a vertical position. Vertical angle members attached along the sides of the upper square tube members serve as keepers that prevent the upper sides from pivoting past a vertical position when the container is being filled.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF PREFERRED EMBODIMENTS

Figure 1:
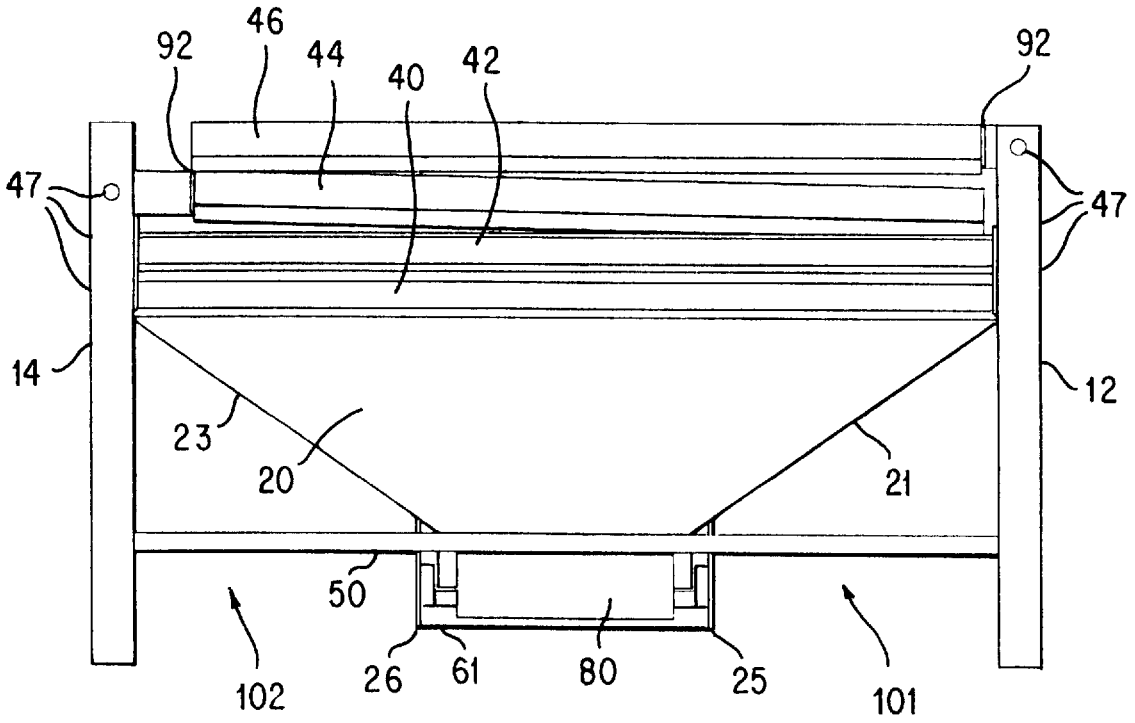
FIG. 1 illustrates a front end elevation view of the container of the present invention with the side walls collapsed to a horizontal position over the base portion.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
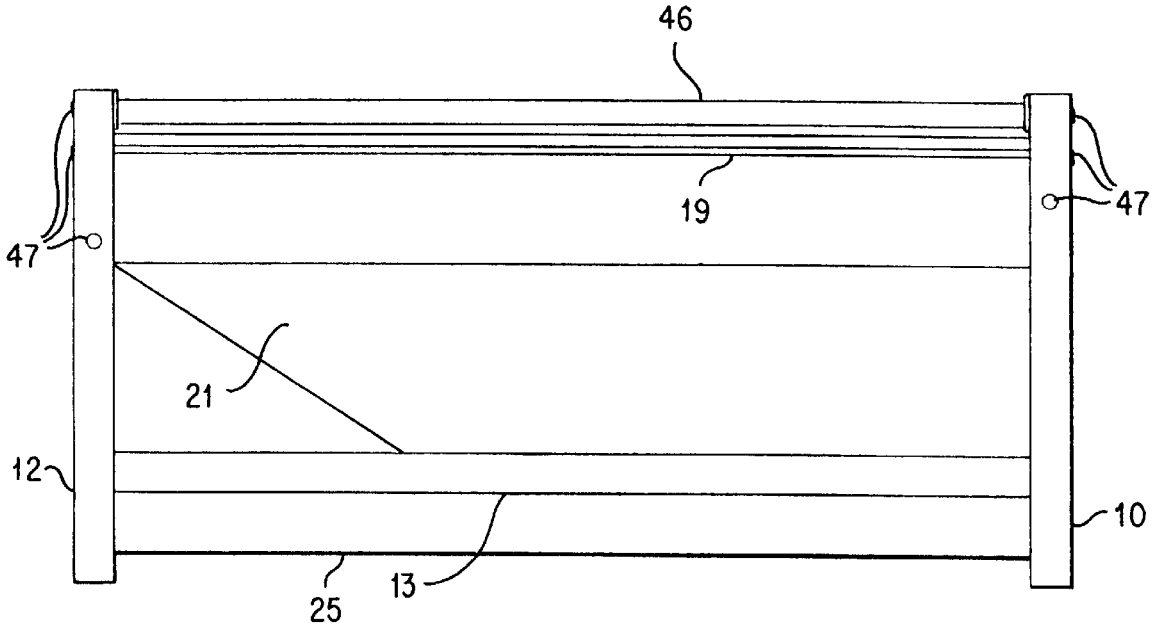
FIG. 2 illustrates a right side elevation view of the container of the present invention with the side walls collapsed to a horizontal position over the base portion.
Figure 5:
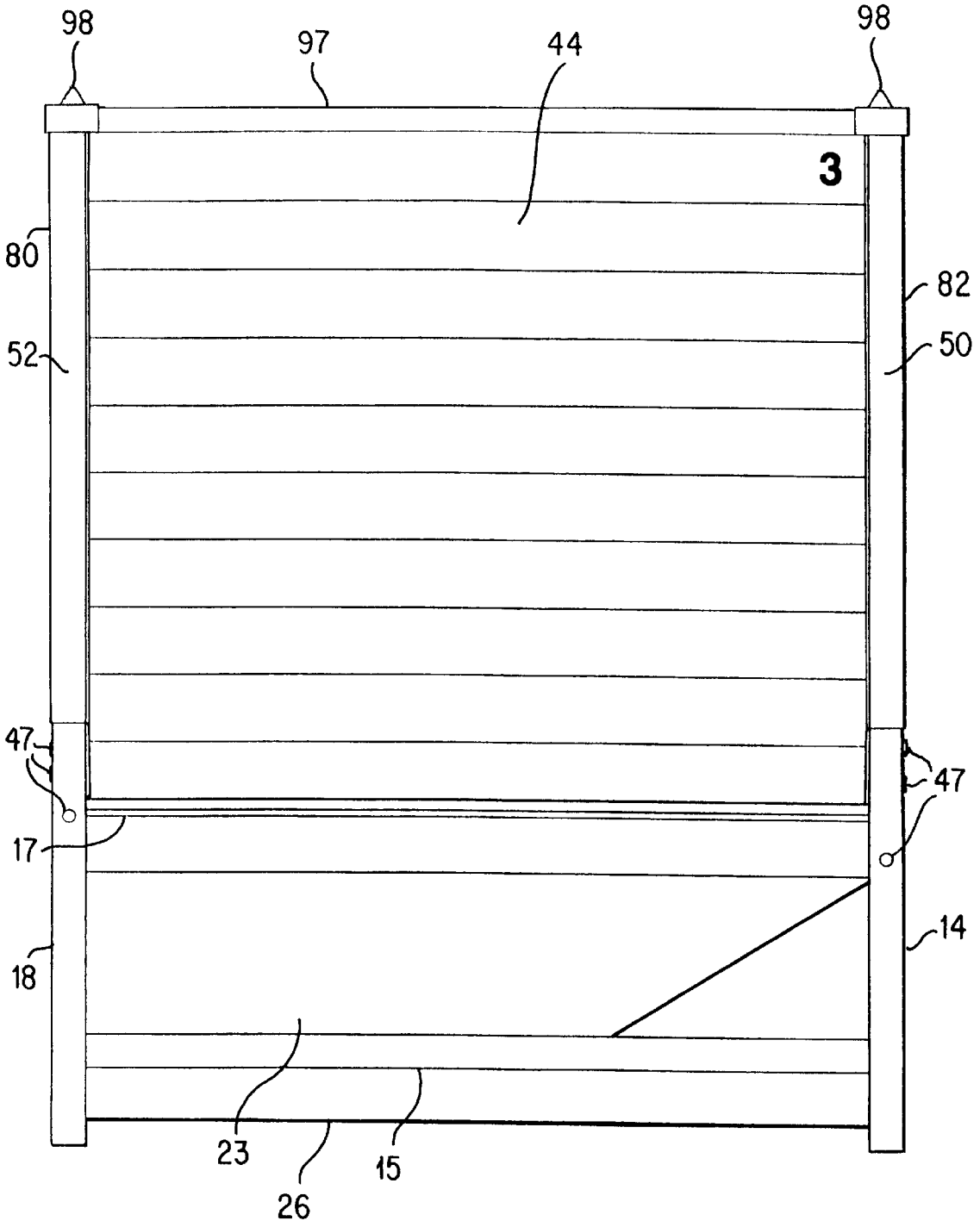
FIG. 5 illustrates a left side elevation view of the container of the present invention with the side walls vertical.

A container according to an embodiment of the present invention includes a base portion and upper side walls than can be pivoted from a vertical position to a horizontal position in order to reduce the overall height of the container for compact storage after the contents of the container have been emptied. The base portion of the container is formed with four vertical square tube members 10, 12, 14 and 16, which define the four corners of the base portion. Two square tubes connect the base corner tubes 10 and 12. As shown in FIG. 2, one tube, 13, is located near the bottom of members 10 and 12 and one tube, 19, is near the top of the base and is under the bent portion of the upper end of the sloped side panel 21. Similarly, two square tubes connect the base corner tubes 14 and 16. As shown in FIG. 5, tube 15 is near the bottom of members 14 and 16 and the other tube, 17, is near the top of the base and is under the bent portion of the upper end of the sloped panel 23.

Figure 3:
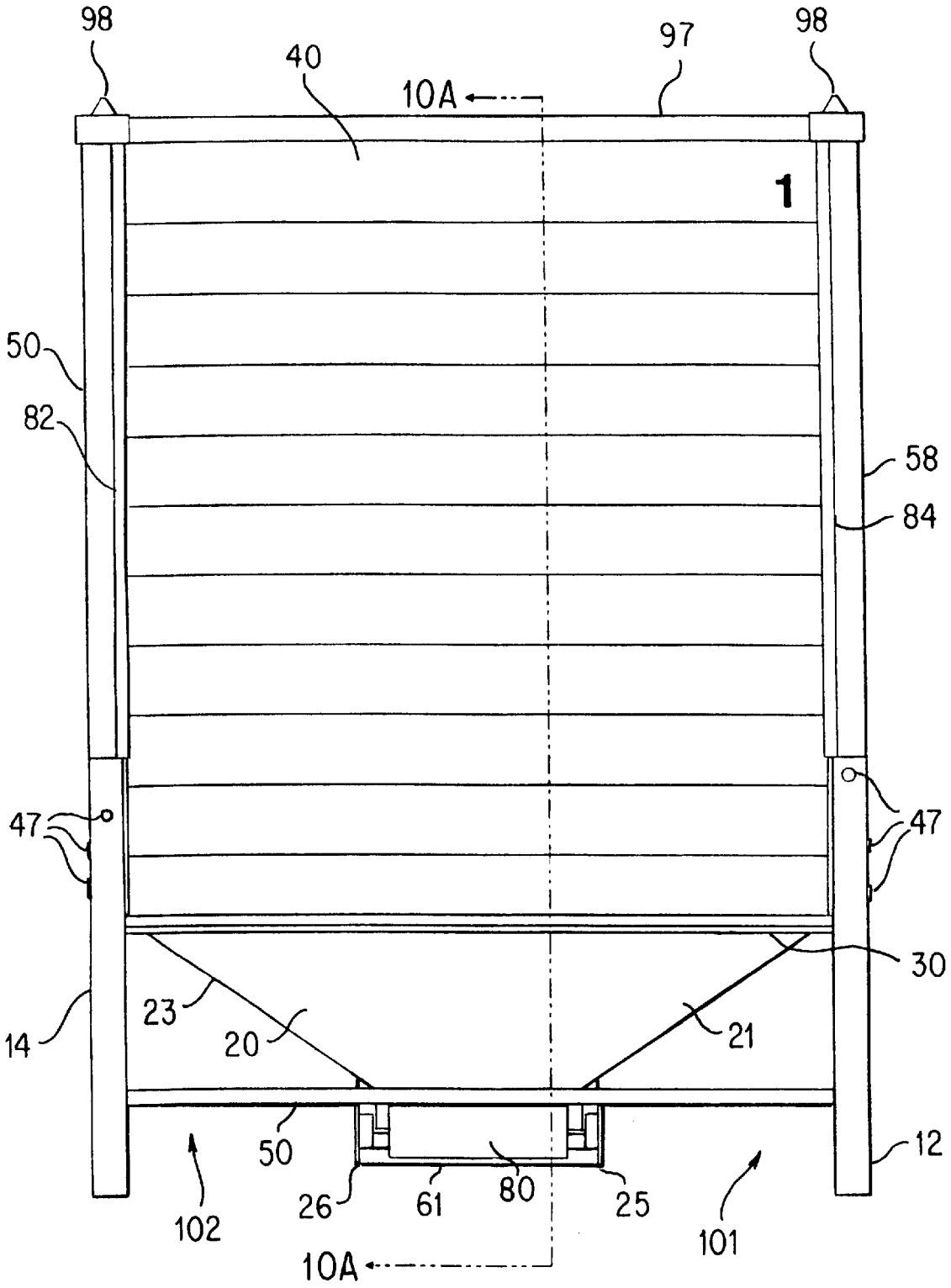
FIG. 3 illustrates a front end elevation view of the container of the present invention with the side walls vertical.
Figure 4:
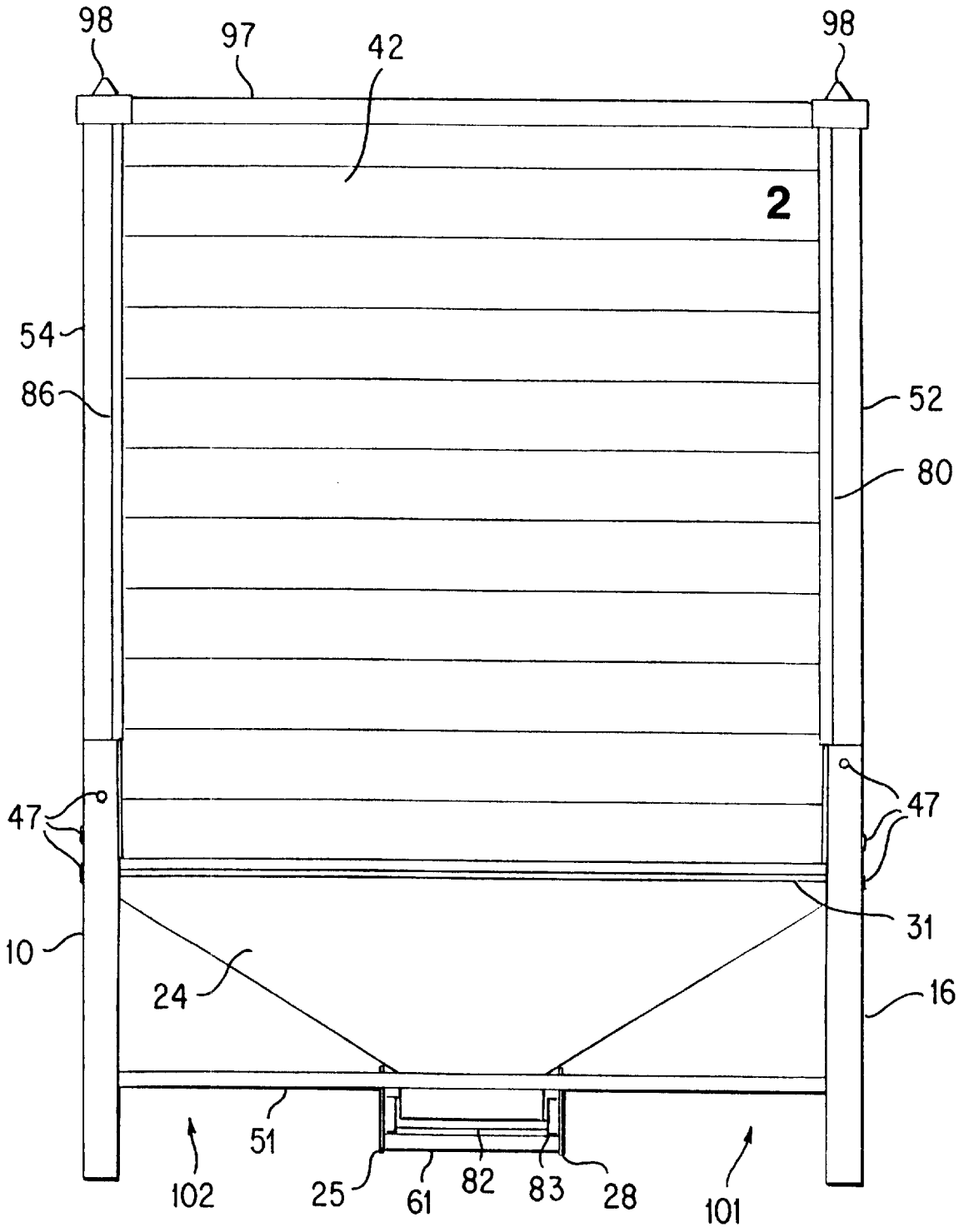
FIG. 4 illustrates a back end elevation view of the container of the present invention with the side walls vertical.

As shown in FIG. 4, base corner tubes 10 and 16 are connected with a tube 31 under the bent portion at the upper end of the vertical panel 24 and a pipe or round tube, 51, near the bottom of the corner tubes 10 and 16. As shown in FIG. 3, base corner tubes 12 and 14 at the opposite end of the base are connected in the same fashion with a tube, 30, under the bent portion at the upper end of the sloped end panel 20 and with a pipe, 50, near the bottom of the tubes. The base portion is thus a structural framework of tubing with flat sloped panels forming the containment portion of the base assembly.

Figure 7:
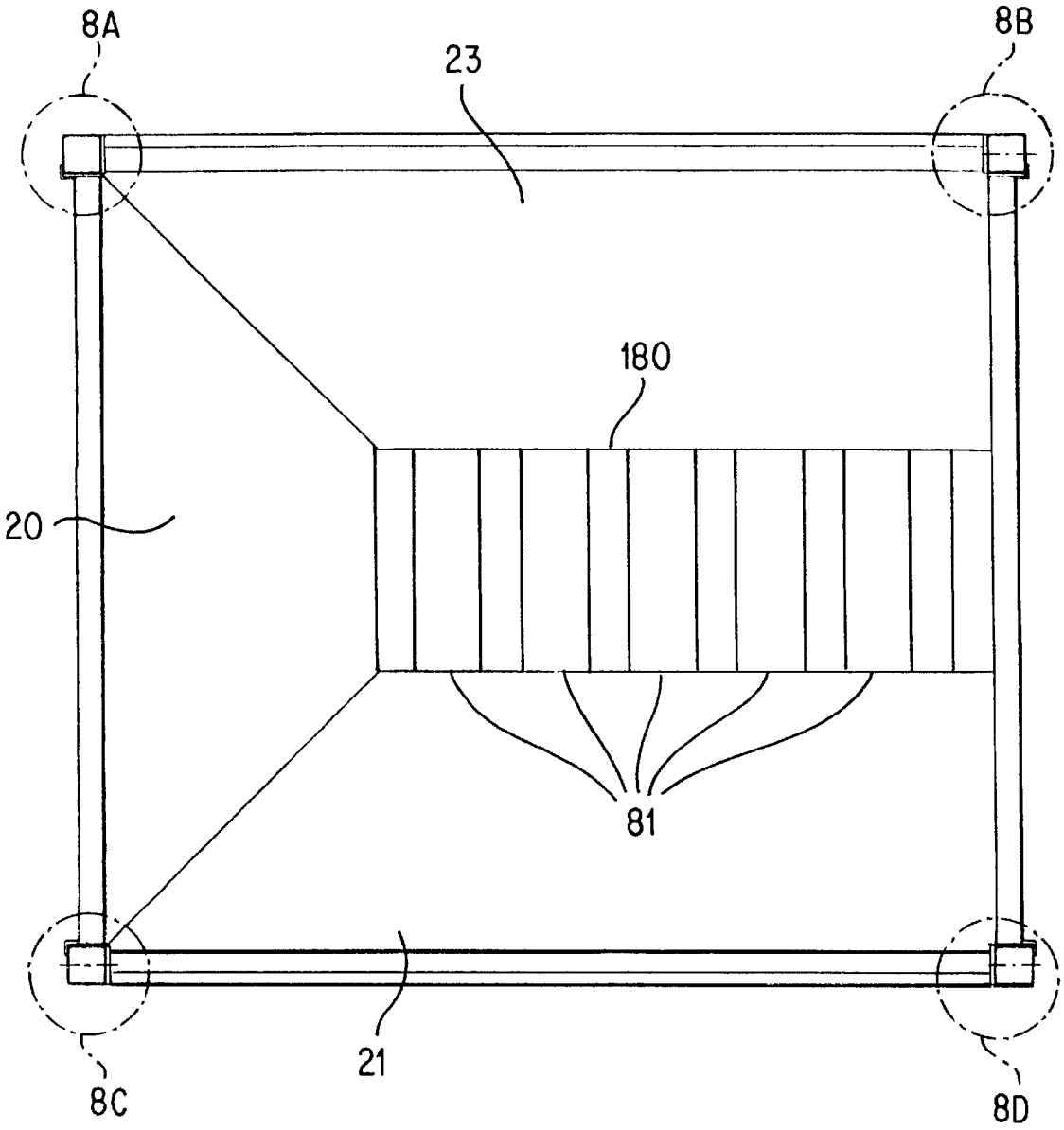
FIG. 7 illustrates a top view of the base portion of the container of the present invention showing the sloping side walls and the bottom opening area.
Figure 8A:
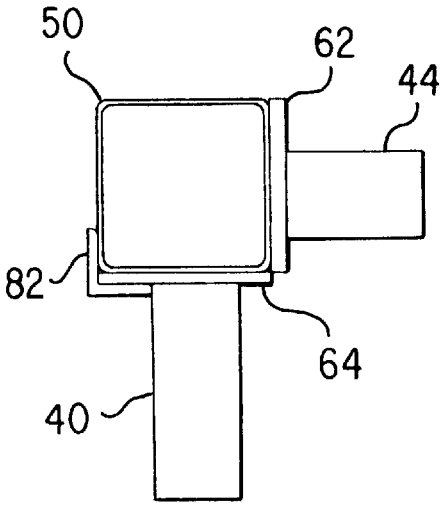
Figs. 8A–8D illustrate details of the vertical tubes and side walls at the corners of the upper portion of the container of the present invention.
Figure 8B:
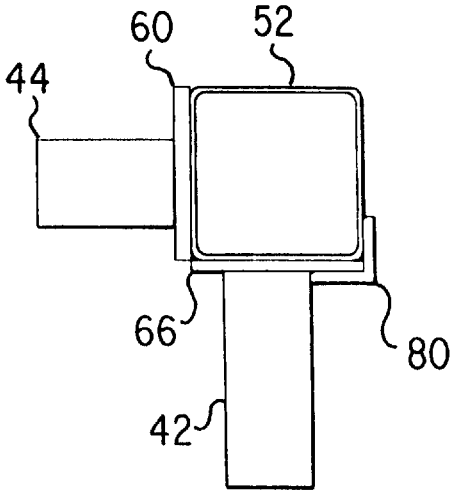
Figure 8C:
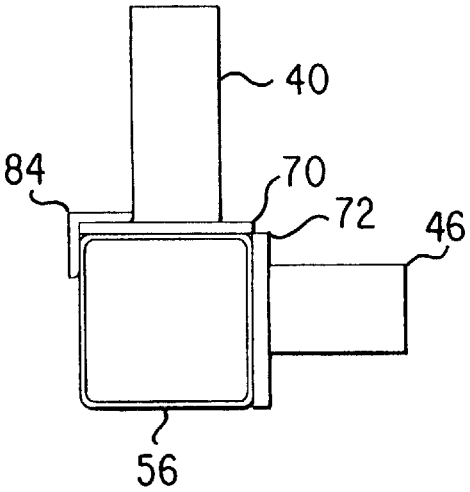
Figure 8D:
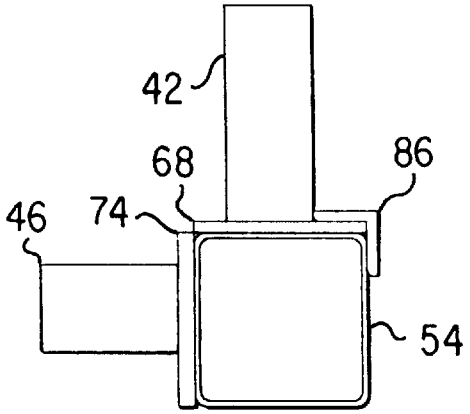
Figure 10A:
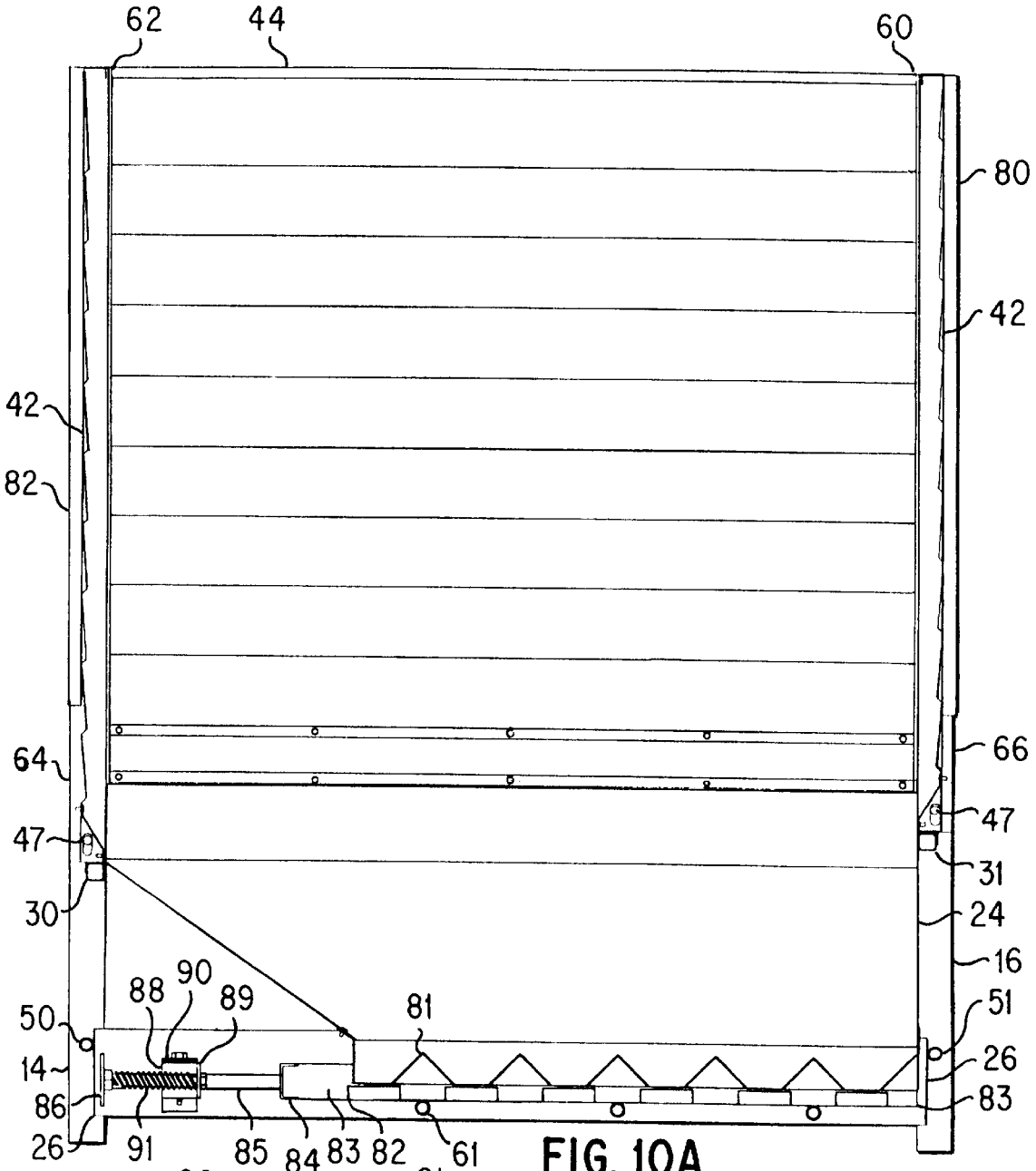
FIGS. 10A and 10B illustrate a section of the container of the present invention showing the slide door at the bottom of the base portion in closed and open positions, respectively.

The areas 101 and 102 under pipe 50 and inside the corner tubes allow entry of standard forklift tines or pallet jack tines to lift the container. Two parallel flat bars, 25 and 26, run between pipes 50 and 51 and frame the area at the center of the container base in which the door is located. Located between these bars and attached to the bottom of the sloped panels is a rectangular assembly 180, as shown in FIG. 7. Within this rectangular assembly 180 are five angles, 81, set perpendicular to the sides of the openings in the bottom of the container and perpendicular to the parallel flat bars, 25 and 26. Six rectangular spaces are formed by the angles and the side plates of the opening assembly. Beneath each of these openings is a plate formed into a channel, 82 as best seen in FIGS. 10A and l0B. These formed channels, 82, close the openings and are connected to two parallel formed channels, 83, running perpendicular to the ends of the closure plates or channels, 82.

Toward side one of the container, the front end, the parallel formed channels, 83, connecting the closure plates, 82, are connected by a channel, 84, which is connected via pipes, 85, to a flat bar push plate, 86, at the front end of the container between base tubes 12 and 14. The six closure channels 82, the parallel side channels 83, the end channel 84, the pipes 85 and the push plate 86 constitute the door assembly.

Figure 10B:
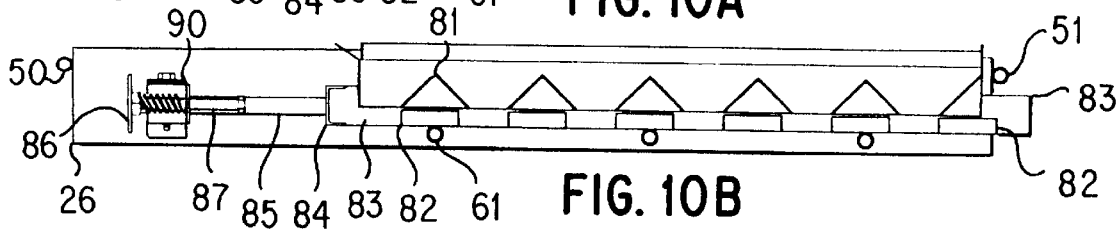
Figure 11:
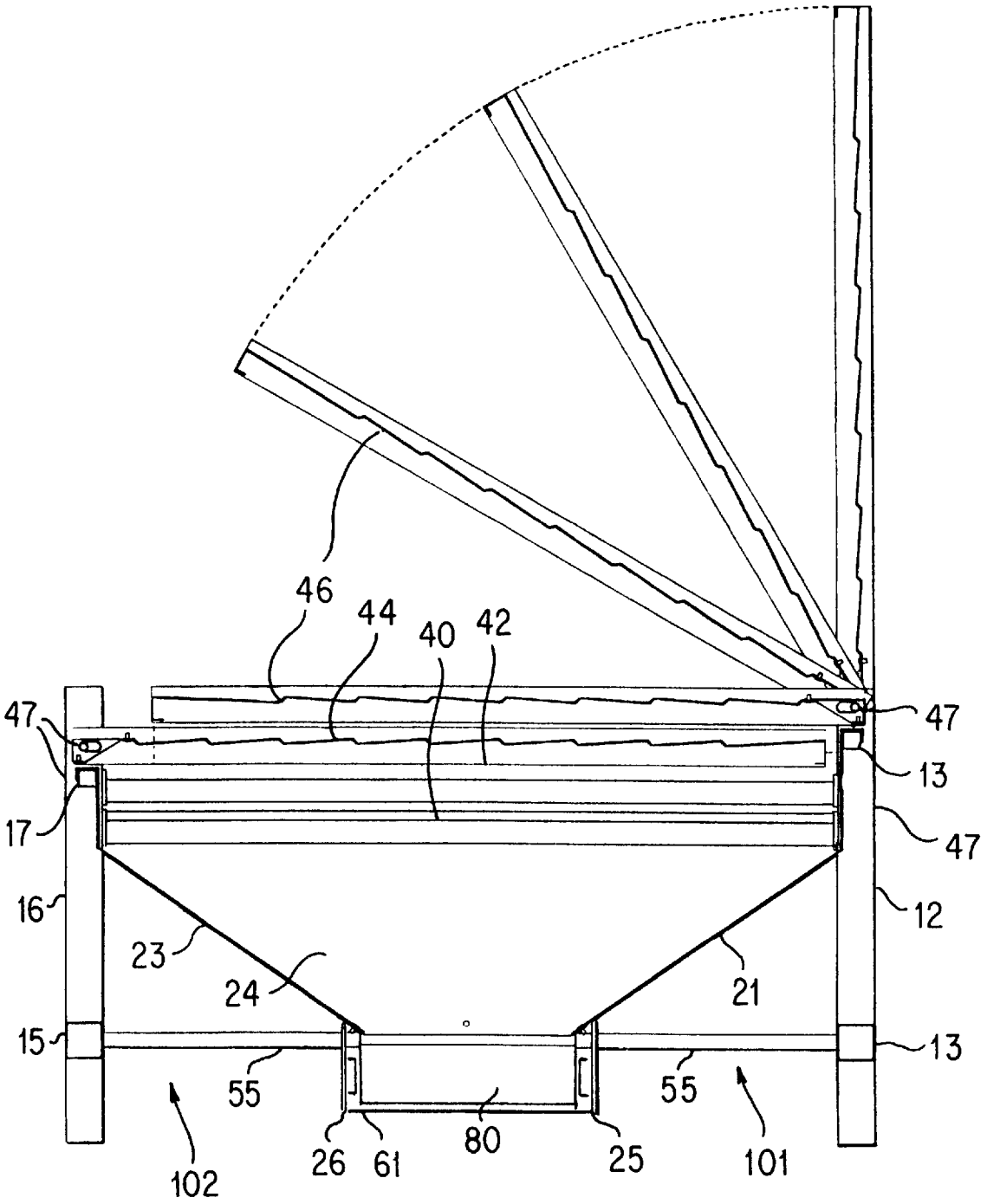
FIG. 11 illustrates a section view of the container of the present invention showing the rotation of the fourth side from the vertical to the horizontal position over the base portion of the container.

As shown in FIGS. 10A and 10B, connected to the push plate 86 is a round shaft, 87, which passes through a short square tube, 88, with a flat bar, 89, at its far end away from the push plate. A hole in the flat bar allows the shaft to pass through but stops the spring, 91, which surrounds the shaft 87. The short tube, 88, is connected to a flat bar, 90, running across its top between the flat bars 25 and 26. The connection of this flat bar, 90, to the flat bars 25 and 26 prevents the tube from moving. Pressing the push plate 86 moves the shaft 87 within the spring, 91, through the hole in the flat bar, 89, across the back of the short tube, 88, and compresses the spring, 91. Also, pushing the plate 86 moves the door assembly connected via the pipes, 85. Removing pressure from the push plate allows the spring to return to the extended position which returns the door assembly to the closed position.

Figure 13A:
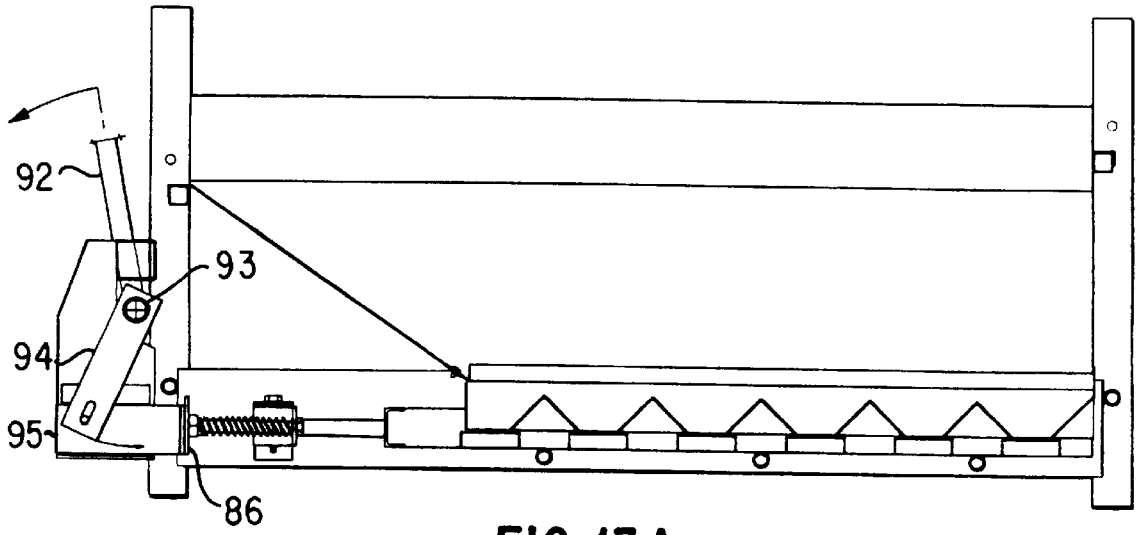
FIGS. 13A and 13B illustrate the remotely actuatable trip mechanism and its relationship to the door in the bottom of the base portion of the container of the present invention.
Figure 13B:
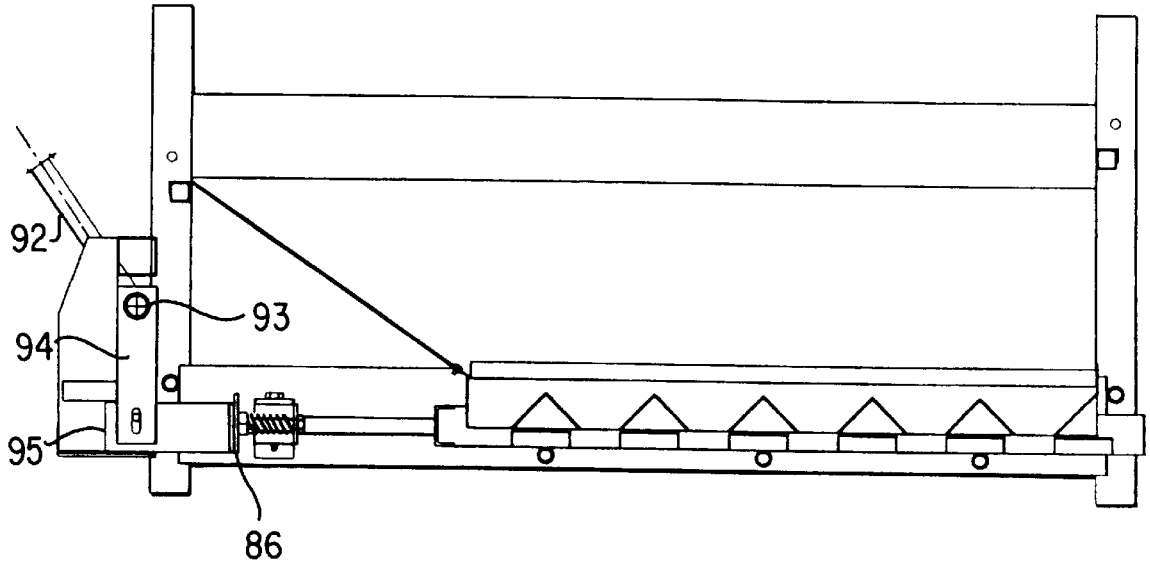

A separate mechanism attached to the base of the container or attached to the forklift tines allows an operator to apply pressure to the push plate without leaving the forklift. As shown in FIGS. 13A and 13B, the front plate of the mechanism is positioned adjacent the end plate 86 of the slide door at the base of the container. A lever, 92, extending from a pipe or tube, 93, across the top of the opening mechanism is connected by a flexible line to a point within reach of the driver of the lift truck when the driver is operating the lift truck. Pulling on the flexible line by the lift truck driver moves the lever, 92, and results in the rotation of the round pipe, 93. The round tube or pipe, 93, is connected to a smaller lever, 94, best seen in FIGS. 13A and 13B, which, when the pipe is rotated, extends a flat bar assembly, 95, which presses against spring loaded push plate, 86, at the end of the door assembly causing the spring 91 to compress and the door assembly to move to an open position.

The bottom surfaces of the containment portion of the container are formed by the sloped panels 20, 21, and 23 and the vertical panel 24 which extend from near the top of the base portion of the container to the top edge of the opening assembly, 180.

The upper portion of the container is formed with upper square tube members 50, 52, 54 and 56, and upper sides 40, 42, 44 and 46. Flat bar members 64 and 70 are connected along opposite edges of the side 40. Similarly, flat bar members 68 and 66 are connected along opposite side edges of side 42. Flat bar members 60 and 62 are connected along opposite side edges of side 44; and flat bar members 60 and 62 are connected to upper tube members 52 and 50. Similarly, flat bar members 72 and 74 are connected along opposite side edges of side 46; and flat bar members 72 and 74 are in turn connected to upper square tube members 56 and 54.

Angle keepers 80, 82, 84 and 86, are also welded to upper square tube members 52, 50, 56 and 54, respectively, such that a gap is defined between the angle keepers and the upper square tube members. The gaps defined between the angle keepers and upper square tube members receive the overlapping portions of the flat bar members 70 and 64, and 66 and 68, connected along the edges of sides 40 and 42, respectively. When all four sides are in a vertical position the interlocking relationship between the flat bar members connected along the edges of the upper sides and the angle keepers connected to the upper square tube members ensures the integrity of the containment portion of the container. The outward pressure created by the material placed in the containment portion of the container holds the upper walls into the interlocking relationship.

When the upper square tube members are positioned in alignment over respective lower square tube members, alignment tabs extending from the bottom openings of the upper square tube members enter the top openings of the lower square tube members to help hold the upper sides in position until the side walls without tubes are rotated to the vertical position at which time the flat bars 68, 66, 64 and 70 lock into the angles 86, 80, 82 and 84. Friction holds the walls in place until enough material is poured into the container to force the upper sides into a tightly interlocked relationship.

Figure 12A:
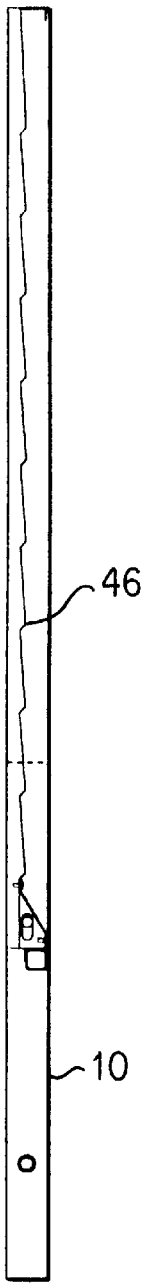
FIGS. 12A–12D illustrate details of the pin and slot at the bottom of each side wall of the container of the present invention.
Figure 12B:
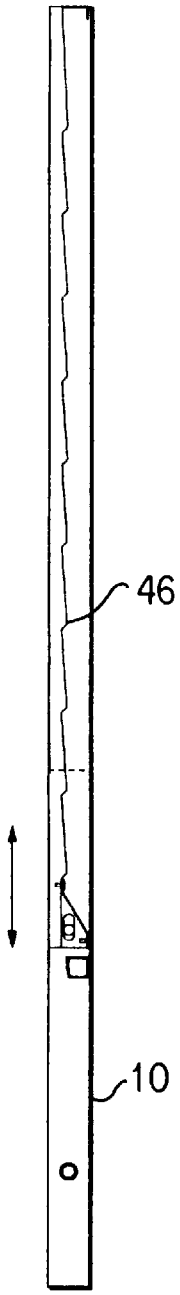
Figure 12C:
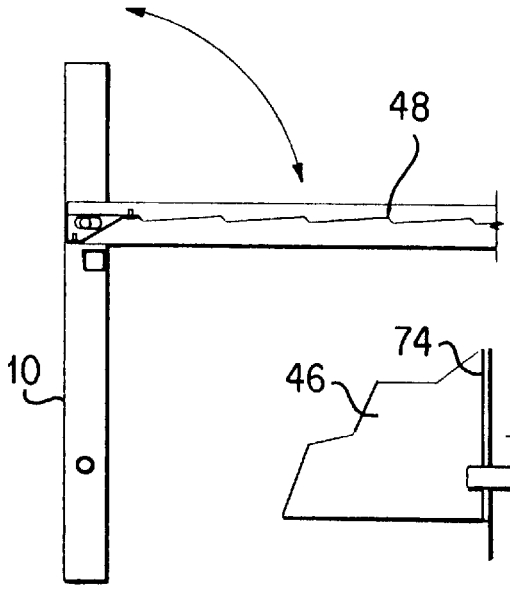
Figure 12D:
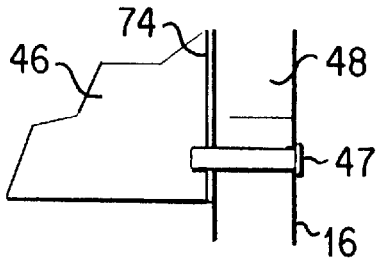

As discussed earlier, the lower ends of the flat bar members connected to the side edges of each side 40, 42, 44 and 46 are provided with slots through which round pins, 47, extend laterally from each of the lower square tube members. The pins 47 have a head which stops the pin at the outside wall of the square tube and spring loaded ball, 48, in the shaft of the pin just inside the outside wall of the tube, as best seen in FIG. 12D. This spring loaded ball 48 holds the pin 47 in place yet allows easy removal should a side wall be damaged and need to be replaced. When it is desired to pivot the side walls of a container to a horizontal position after emptying of the container, each of the side walls can be lifted vertically relative to the lower square tube members as a result of the slots through the flat bar members along the edges of the sides. This vertical movement of each side disengages the alignment tabs extending from the lower end of each upper square tube member from the opening at the upper end of each lower square tube member. After disengagement of the alignment tabs, the sides with tubes can be pivoted from the vertical position to the horizontal position. In a preferred embodiment each of the sides 40 and 42 is folded inwardly to a horizontal position in sequence with the sides that are not connected to the upper square tube members being folded inwardly first followed sequentially by the sides 44 and 46 that are connected to the upper square tube members.

Figure 6:
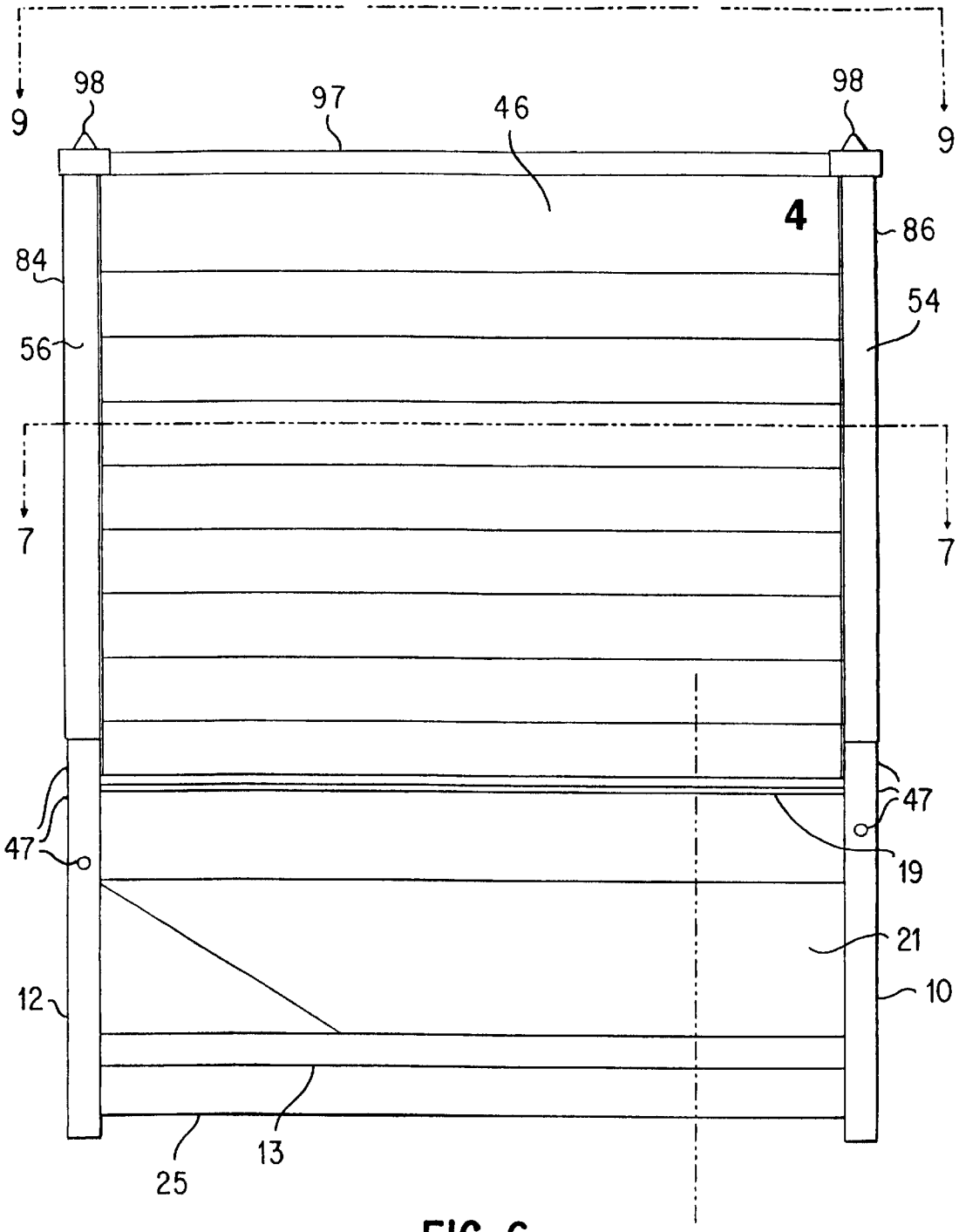
FIG. 6 illustrates a right side elevation view of the container of the present invention with the side walls vertical.
Figure 9:
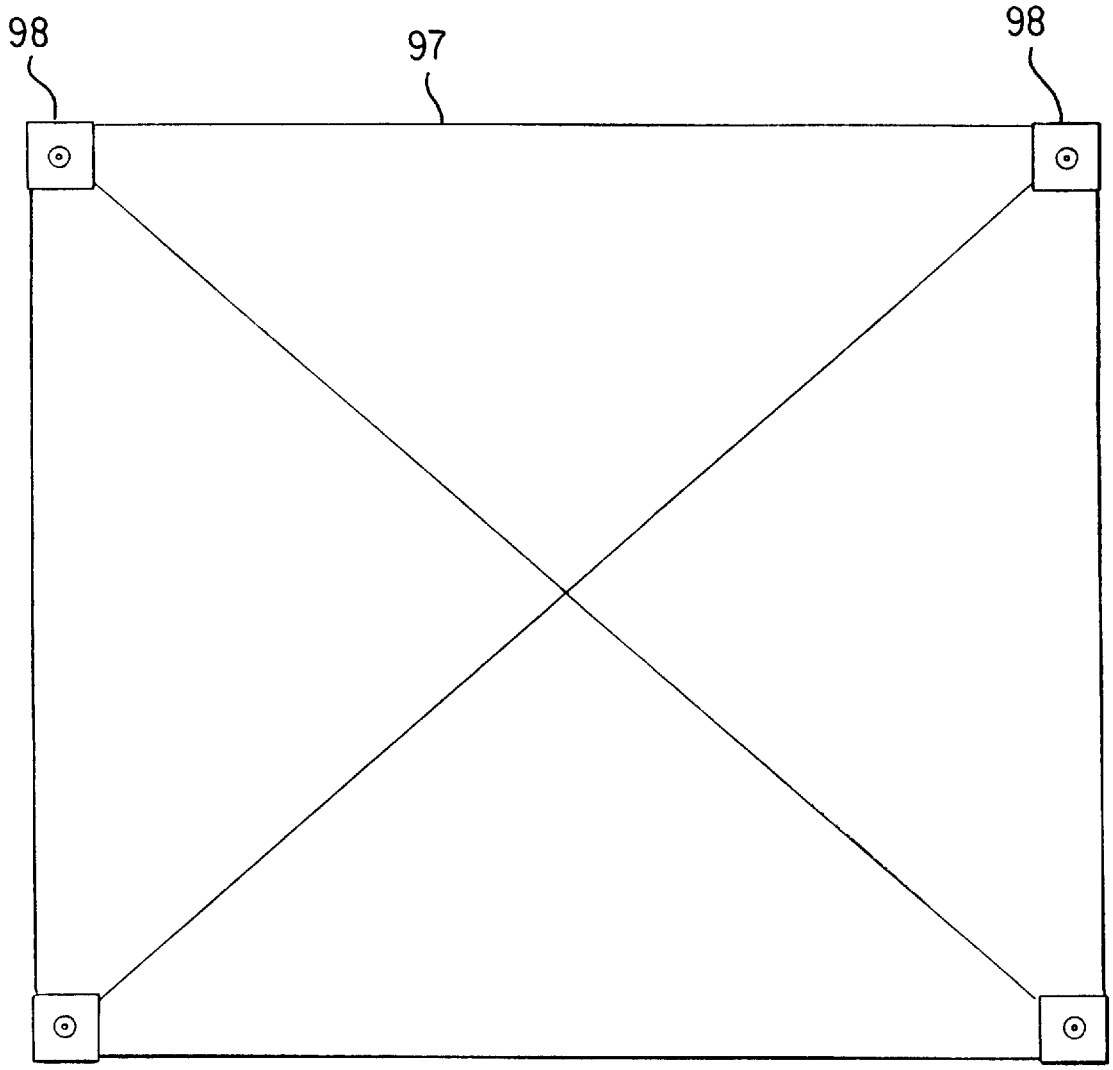
FIG. 9 illustrates a top view of the lid of the present invention showing the corner alignment cones.

As shown in FIGS. 6 and 9, a cover 97 is provided over the top of the container when all four upper sides are in an interlocked vertical position or when all four sides are folded down to a horizontal position across the lower portion of the container. Molded plastic index cones 98 at each corner of cover 97 extend upward and provide alignment means for stacking an additional container on top of a covered container. The index cones 98 protrude into the openings at the bottoms of the lower square tube members on the stacked container.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

What is claimed is:

1. A collapsible, stackable container, comprising:

a base portion;

said base portion including a structural frame and sloped panels;

an opening assembly at the bottom of said base portion which divides an opening in the bottom of the container into a series of smaller spaced openings for emptying contents from said container;

a sliding door assembly under said opening assembly in the bottom of said base portion for closing the smaller spaced openings in the opening assembly of said container; and an upper portion with a plurality of substantially rigid side walls;

each of said side walls being pivotally connected to said base portion and movable from a horizontal position across the top of said base portion to a vertical position extending upwardly from said base portion and defining a containment cavity between said side walls.

2. The container of claim 1, wherein:

said sliding door assembly is provided with a spring mechanism and push plate at one end, and further including a lever mechanism which provides means for remote opening and automatic closing of said sliding door assembly.

3. The container of claim 1, wherein said base portion includes structure across the base portion to receive forklift or pallet jack tines which permit lifting and transport of said container via forklift or pallet jacks.

4. The container of claim 1, wherein said container is strong enough to support stacking of the container four high with the side walls in the vertical position and the containment cavity filled with approximately 2500 pounds of loose material.

5. The container of claim 1, wherein a total height of said container with the side walls folded across the base portion is less than half a total height of the container with the side walls in a vertical position.

6. The container of claim 1, wherein the structural frame of the base portion allows for stacking of additional containers with the side walls of the upper portion pivoted horizontally across the base portion.

7. A collapsible, stackable container, comprising:

a base portion, said base portion including sloped bottom surfaces with lower edges of said bottom surfaces defining a discharge opening and upper edges of said bottom surfaces being connected to four vertical lower tube members positioned at four corners of said container;

a door assembly slidably supported below said discharge opening on structural members connected to lower ends of said lower tube members;

biasing means for urging said door assembly toward a position wherein said door assembly closes said discharge opening, and a remotely actuatable pivot mechanism associated with one end of said door assembly such that an operator located too far from said door assembly to physically reach said door assembly can remotely actuate said pivot mechanism to slide said door assembly against said biasing means to open said discharge opening; and an upper portion having side walls that are pivotally connected at lower ends thereof to said lower tube members such that said side walls can be pivoted from horizontal positions across the top of said base portion to vertical positions extending upwardly from said base portion and defining a containment cavity between said side walls.

8. The container of claim 7, wherein:

two opposite side edges of each of two opposite side walls are connected to upper tube members such that when said two opposite side walls are pivoted to vertical positions said upper tube members are aligned with said lower tube members.

9. The container of claim 8, wherein:

two opposite side edges of each of two other opposite side walls are connected to flat plates; and each of said upper tube members being provided along a longitudinal edge thereof with an angle keeper that receives on of said flat plates when said two opposite side walls and said two other opposite sidewalls are pivoted to vertical positions and said angle keepers preventing said side walls from pivoting outwardly beyond vertical.

10. The container of claim 7, wherein:

a plurality of parallel, spaced angle members divides said discharge opening into a series of parallel, spaced discharge openings and said door assembly includes a series of parallel, spaced closure members that are spaced from each other in a direction perpendicular to the direction of movement of said door assembly when said door assembly closes and opens, such that movement of said door assembly by an amount equal to the width of one of said parallel, spaced discharge openings completely opens or completely closes all of said parallel, spaced discharge openings.

11. The container of claim 10, wherein:

two opposite side edges of each of two opposite side walls are connected to upper tube members such that when said two opposite side walls are pivoted to vertical positions said upper tube members are aligned with said lower tube members.

12. The container of claim 11, wherein:

two opposite side edges of each of two other opposite side walls are connected to flat plates; and each of said upper tube members being provided along a longitudinal edge thereof with an angle keeper that receives one of said flat plates when said two opposite side walls and said two other opposite side walls are pivoted to vertical positions and said angle keepers preventing said side walls from pivoting outwardly beyond vertical.

13. The container of claim 7, wherein:

said pivot mechanism is separable from said container such that said pivot mechanism can be used with other containers; and said base portion includes structural elements that define openings for tines of forklifts or pallet jacks, said structural elements permitting lifting and transporting of said container with as much as 2500 pounds of loose material contained within said containment cavity.

* * * * *